US008628394B2

(12) United States Patent
Patnoe

(10) Patent No.: US 8,628,394 B2
(45) Date of Patent: Jan. 14, 2014

(54) STRATEGIC SLIDE MECHANIC FOR REPLACING TILES IN WORD GAMES

(75) Inventor: Christopher D. Patnoe, Palo Alto, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 13/409,382

(22) Filed: Mar. 1, 2012

(65) Prior Publication Data

US 2013/0231167 A1 Sep. 5, 2013

(51) Int. Cl.
*A63F 9/24* (2006.01)

(52) U.S. Cl.
USPC ..... 463/9; 463/10

(58) Field of Classification Search
USPC ..... 273/236, 272, 292, 299, 302; 463/9–10, 463/13, 31, 42
See application file for complete search history.

(56) References Cited

U.S. PATENT DOCUMENTS

| | | | | |
|---|---|---|---|---|
| 4,630,831 | A * | 12/1986 | Stadden | 273/292 |
| 5,014,996 | A * | 5/1991 | von Braunhut | 273/299 |
| 5,100,150 | A * | 3/1992 | Larman | 273/272 |
| 5,678,820 | A * | 10/1997 | Miller | 273/249 |
| 6,378,867 | B1 * | 4/2002 | Shalless | 273/240 |
| 6,422,561 | B1 * | 7/2002 | Schroeder | 273/272 |
| 6,446,967 | B1 * | 9/2002 | Jamali | 273/236 |
| 6,623,009 | B1 * | 9/2003 | Kraemer et al. | 273/272 |
| 6,769,692 | B1 * | 8/2004 | Cavalluzzo | 273/272 |
| 7,549,644 | B1 * | 6/2009 | Meernik | 273/299 |
| 8,366,546 | B1 * | 2/2013 | Naik et al. | 463/31 |
| 2005/0006844 | A1 * | 1/2005 | Cavallo | 273/272 |
| 2005/0014545 | A1 * | 1/2005 | Nara | 463/13 |
| 2005/0035549 | A1 * | 2/2005 | Zeng | 273/292 |
| 2005/0077681 | A1 * | 4/2005 | Kowalczyk | 273/302 |
| 2006/0261549 | A1 * | 11/2006 | Germain | 273/243 |
| 2008/0258387 | A1 * | 10/2008 | Lu et al. | 273/272 |
| 2010/0041456 | A1 * | 2/2010 | Yu | 463/10 |
| 2010/0151947 | A1 * | 6/2010 | Sato et al. | 463/42 |
| 2011/0012307 | A1 * | 1/2011 | Chou | 273/292 |
| 2011/0230246 | A1 * | 9/2011 | Brook et al. | 463/9 |

(Continued)

OTHER PUBLICATIONS

Leena Rao, Zynga Brings Scrabble-Like 'Words With Friends' to the Web With New Facebook Game, Aug. 1, 2011, http://techcrunch.com/2011/08/01/zynga-brings-scrabble-like-words-with-friends-to-the-web-with-new-facebook-game/.*

Matthew Lynley, Zynga brings Words With Friends to Facebook, Aug. 1, 2011, http://venturebeat.com/2011/08/01/words-with-friends-facebook/.*

(Continued)

*Primary Examiner* — Dmitry Suhol
*Assistant Examiner* — Jason Yen
(74) *Attorney, Agent, or Firm* — Patterson & Sheridan, LLP

(57) ABSTRACT

A word game with a sliding mechanic. A game board includes a play area including a plurality of tiles and at least two bench areas, each including a set of tiles. Each of the bench areas is arranged as a column or a row adjacent to the play area. Each tile in the plurality of tiles and the second plurality of tiles specifies a letter and a point value. At least one round of the word game is played. A round includes a turn for each player. A turn includes receiving an ordered selection of tiles within the play area that form a word, removing the tiles in the ordered selection of tiles from the play area, and receiving a selection of one of the at least two bench areas. Empty tiles within the play area are replaced by sliding tiles from the selected bench area onto the play area.

24 Claims, 9 Drawing Sheets

(56) References Cited

U.S. PATENT DOCUMENTS

| | | | | |
|---|---|---|---|---|
| 2012/0032401 | A1* | 2/2012 | Loriz et al. | 273/299 |
| 2012/0104695 | A1* | 5/2012 | Shenoy | 273/292 |
| 2012/0252574 | A1* | 10/2012 | Chow et al. | 463/31 |

OTHER PUBLICATIONS

Zynga, Words with friends How to Play, Aug. 3, 2011, http://zyngawithfriends.com/wordswithfriends/support/WWF_How_To_Play.html.*

* cited by examiner

300

| | | | | | |
|---|---|---|---|---|---|
| I | $B_3$ | $D_2$ | $Q_{10}$ $310_1$ | $Y_4$ | $N_1$ |
| P | $P_3$ | $E_1$ | $U_1$ $310_2$ | $I_1$ $310_3$ | $L_1$ $310_4$ |
| S | $Z_{10}$ | $X_8$ | $A_1$ | $T_1$ $310_5$ | $A_1$ |
| O | $W_4$ | $D_2$ | $N_1$ | $R_1$ | $M_1$ |
| L | $O_1$ | $A_1$ | $P_3$ | $U_1$ | $P_3$ |
| | | | | | |
| | O | R | E | T | S |

FIG. 3A

340

| | | | | | |
|---|---|---|---|---|---|
| I | $B_3$ | $D_2$ | $Y_4$ $345_1$ | $N_1$ $345_2$ | $O_1$ $345_3$ |
| P | $P_3$ | $E_1$ | $R_1$ $345_4$ | $X_8$ $345_5$ | $B_3$ $345_6$ |
| S | $Z_{10}$ | $X_8$ | $A_1$ $345_7$ | $A_1$ $345_8$ | $E_1$ $345_9$ |
| O | $W_4$ | $D_2$ | $N_1$ | $R_1$ | $M_1$ |
| L | $O_1$ | $A_1$ | $P_3$ | $U_1$ | $P_3$ |

D $350_1$ L $350_2$ J $350_3$ T S

FIG. 3C

STRATEGIC SLIDE MECHANIC FOR REPLACING TILES IN WORD GAMES

BACKGROUND

1. Field of the Invention

Embodiments presented in this disclosure generally relate to computer games and, more particularly, to a slide mechanic for replacing tiles in a computer word game.

2. Description of the Related Art

Word-forming games using individual letters of the alphabet as pieces within the game are a very popular form of game. For instance, SCRABBLE® is one of the most famous word-forming games. In this game, players receive a number of tiles containing letters and point values from a fixed set of tiles which never changes. The point values associated with the individual tiles are based on the frequency of the letters in the specific language. Players attempt to use all of their tiles to make words which they place on a game board, each player building on the first and subsequent words that are formed on the game board such that the result looks like a crossword puzzle. Players add up the points on each of the letter tiles they use in their words and record the result. Players end up with a total of points for the game which they compare with each others' score to determine a winner. Additionally, there are variations and other similar word-forming games that have features similar to those in SCRABBLE®. For instance, some of these games use playing cards instead of tiles and do not use a game board.

BOGGLE® is another type of word-forming game. In this game, the game board includes a rectangular array of letters and players are expected to form as many words from adjacent letters as is possible in a fixed time. In some variations, the letters are replaced by other letters once used. In other variations, the rectangular array of letters is fixed throughout the game. Several other popular games on the market derive from BOGGLE®, including BOOKWORM®. In BOOKWORM®, the game board includes a substantially rectangular array of letters and players attempt to form words using adjacent letters. As words are formed, the tiles used to form the words are removed from the game board and new letters appear from the top of the game board to replenish the removed tiles.

Yet another word-forming game is Word Yahtzee™. In this game, the letters are chosen by rolling dice which have letters on their faces. After a roll of the dice, the player has a set amount of time to make as many words as possible out of the letters rolled. The scoring in Word Yahtzee™ is somewhat complex, being based on a per letter value (i.e., as in Scrabble) with a number of other special situations (e.g., all vowels).

Some card-based word games consist of a deck of cards each of which contains a letter of the alphabet and a point designation. Player attempts to use all of his or her cards to form a word or words before other players. Many of these games also score the game by adding up the point values of the letters used in the words. Examples of such card-based word games include Letras® and Quiddler®. Both Letras® and Quiddler® include a method of play in which one game consists of several hands of cards. In Letras®, the dealer decides on the number of cards between three and eight to be dealt in each hand. Hands are dealt and words formed until a player accumulates a certain predetermined number of points. In Quiddler®, the number of cards dealt in each hand is fixed, with the first hand being three cards, the next four, and so on up to a hand of ten cards. The point scores the players have earned are then compared and a winner is determined.

SUMMARY

Embodiments described herein provide a method, system and computer program product for playing a word game with at least two players. The method, system and computer program product include providing a game board, where the game board includes a play area including a plurality of tiles from a deck of tiles and at least two bench areas, each including a set of tiles from the deck of tiles. Here, each of the at least two bench areas are arranged as a column or a row adjacent to the play area, and wherein each tile in the plurality of tiles and the second plurality of tiles specifies a letter and a point value. The method, system and computer program product also include providing logic to facilitate play of at least one round of the word game, where a round includes a turn for each of the at least two players. Additionally, a turn includes receiving an ordered selection of tiles within the play area that form a word, removing the tiles in the ordered selection of tiles from the play area, receiving a selection of one of the at least two bench areas and replacing empty tiles within the play area by sliding tiles from the selected bench area onto the play area.

BRIEF DESCRIPTION OF THE DRAWINGS

So that the manner in which the above recited aspects are attained and can be understood in detail, a more particular description of embodiments of the invention, briefly summarized above, may be had by reference to the appended drawings.

It is to be noted, however, that the appended drawings illustrate only typical embodiments of this invention and are therefore not to be considered limiting of its scope, for the invention may admit to other equally effective embodiments.

FIGS. 3A-C are screenshots illustrating game boards for a word game client, according to one embodiment described herein.

DETAILED DESCRIPTION

Figure 1:
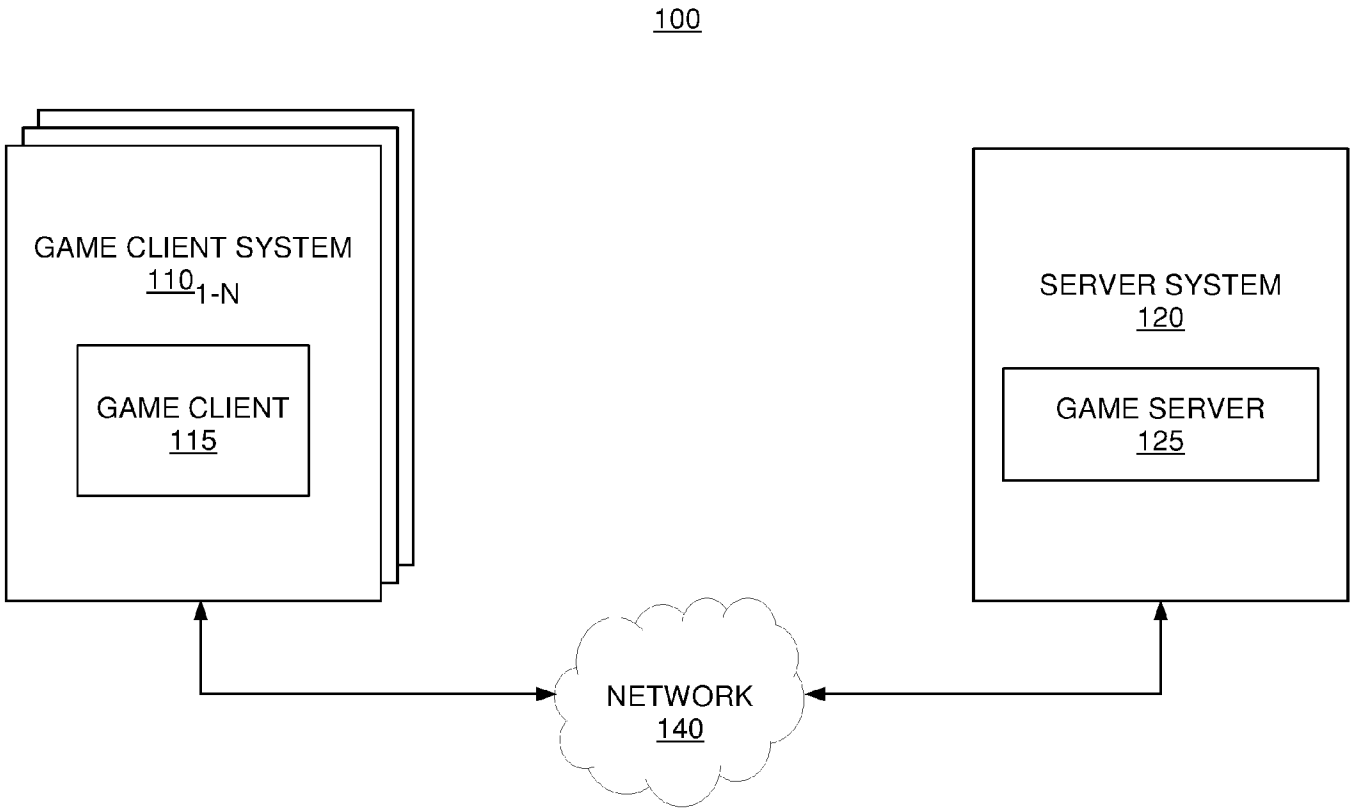
FIG. 1 is a block diagram illustrating a system configured with a word game client, according to one embodiment described herein.

Embodiments described herein generally provide a sliding mechanic for use in a word game. FIG. 1 is a block diagram illustrating a system configured with a word game client, according to one embodiment described herein. As shown, the system 100 includes a plurality of game client systems $\mathbf{110}_{1\text{-}N}$ interconnected with a game server system 120 via a network 140. In the depicted embodiment, each of the game client systems $\mathbf{110}_{1\text{-}N}$ contains a game client 115. The game client 115 generally represents an application through which a player may play the word game. In the depicted embodiment, the game server system 120 also contains a game server 125, which provides a centralized application to which two or more game clients 115 may connect to play the word game.

Of course, the depicted embodiment is but one example of an environment in which embodiments may be used and one of ordinary skill in the art will recognize that other configurations (e.g., a client-to-client connection) could be used instead. For example, in one embodiment, the game client 115 on the game client system $\mathbf{110}_1$ could be configured to communicate directly with the game client 115 on the game client system $\mathbf{110}_2$ in order to play the word game. In such an embodiment, the clients 115 could be configured to control the gameplay of the word game without any interaction with the game server 125. In a particular embodiment, the word game may be played by a single user using one of the game clients 115 against one or more virtual opponents. For example, the user on the game client 115 on the game client system $\mathbf{110}_1$ could play the game by himself against one or more virtual opponents (i.e., in single player mode).

Generally, the word game may include a game board that includes a play area and two or more bench areas. The play area includes a plurality of tiles arranged in a grid (e.g., a 5 column by 7 row formation), where each tile includes a letter value and a point value. For example, a first tile could include the letter "A" and the point value of "1", while a second tile could include the letter "B" and the point value of "3". In one embodiment, point values are assigned to letters based on the estimated difficulty of using the letter to form a word. As an example, while the letter "A" may be associated with the point value of "1" (i.e., since the letter "A" frequently occurs in words), the letter "Z" may be associated with the point value of "10" (i.e., since very few words contain the letter "Z"). More generally, however, any arrangement of letters and point values may be used consistent with the embodiments described herein.

Of note, although embodiments detailed herein are described with respect lettered tiles, it is broadly contemplated that embodiments may be practiced using other gaming instruments as well. For example, embodiments may be configured for use with gaming instruments such as, without limitation, game pieces with various shapes and/or colors, lettered instruments, numbered instruments, playing cards or other cards, and so on. More generally, embodiments described herein may be practiced with any gaming instruments arranged in a grid-based formation, consistent with the techniques and functionality described herein.

Additionally, the tiles (or other gaming instruments) on the play area may be randomly selected from a deck of tiles that contains a predetermined number of tiles for each letter. In one embodiment, the allocation of tiles within the deck is determined based on the frequency each letter is used across a plurality of words. For example, if the letter "A" is used in words more frequently than the letter "Z" across all the words recognized by the word game (e.g., across the words in an electronic dictionary used by a word game), the deck could be adjusted to contain more tiles for the letter "A" than tiles for the letter "Z". Advantageously, doing so helps to ensure that players may more easily form words using tiles selected from the deck. Additionally, the deck may include one or more wildcard tiles that are not associated with any particular letter. Rather, a player may use a wildcard tile to take the place of any letter selected by the player.

Generally, the word game is played by two or more players, who take turns forming words by connecting adjacent tiles from the play area. Of note, in one embodiment, the word game can be played as a single player game between one player and one or more virtual opponents. Players may form words using tiles that are above or below the previous tile, left or right of the previous tile, or even tiles that are diagonally adjacent to the previous tile. Upon selecting an ordered set of tiles that spell out a word, a number of points may be awarded to the player based on the tiles used in forming the word. For example, in one embodiment, a game client is configured to add up the points for all of the tiles used to spell the word and to assign the sum of these points to the user. In one embodiment, the play area may also contain particular areas that are designed as bonus squares. In such an embodiment, if a tile located on a bonus square is used in forming a word, a bonus may be applied to the points earned for the word. For example, one such bonus could a "Double Word Score" bonus, which doubles the points earned for the word.

Each of the two or more bench areas also includes a number of the tiles. In one embodiment, each bench area is represented as a single row or a single column and is positioned adjacent to one of the edges of the play area. In other embodiments, the bench areas may include multiple rows and columns. Once a player selects an ordered set of tiles to spell out a word, the selected tiles are removed from the play area. The player who selected the tiles may then select one of the benches for use in replenishing the empty squares in the play area. Upon selecting one of the benches, tiles from the bench may slide onto the play area, causing any intermediate tiles already on the play area to slide over as well. Random tiles from the deck may be selected to repopulate the bench area as the tiles slide onto the play area. The repopulating and sliding steps may be repeated until all the empty squares in the play area have been filled.

The players may continue taking turns until a predetermined number of rounds (e.g., 10 rounds) have been played, with each round consisting of a turn for each player in the game. In one embodiment, the gameplay may continue until one of the players has earned a predetermined number of points (e.g., 100 points). Once the game has ended, the player who has earned the most points throughout the game is declared the winner. If a player is unable to find an adjacent set of tiles within the play area that spell out a word, the player may then choose to pass his turn. In a particular embodiment, if all of the players pass their turns for a particular configuration of tiles in the play area (i.e., all of the players pass their turns in a row), the game may then end and a winner may be selected based on the player who has the most points at that moment in time.

Figure 2:
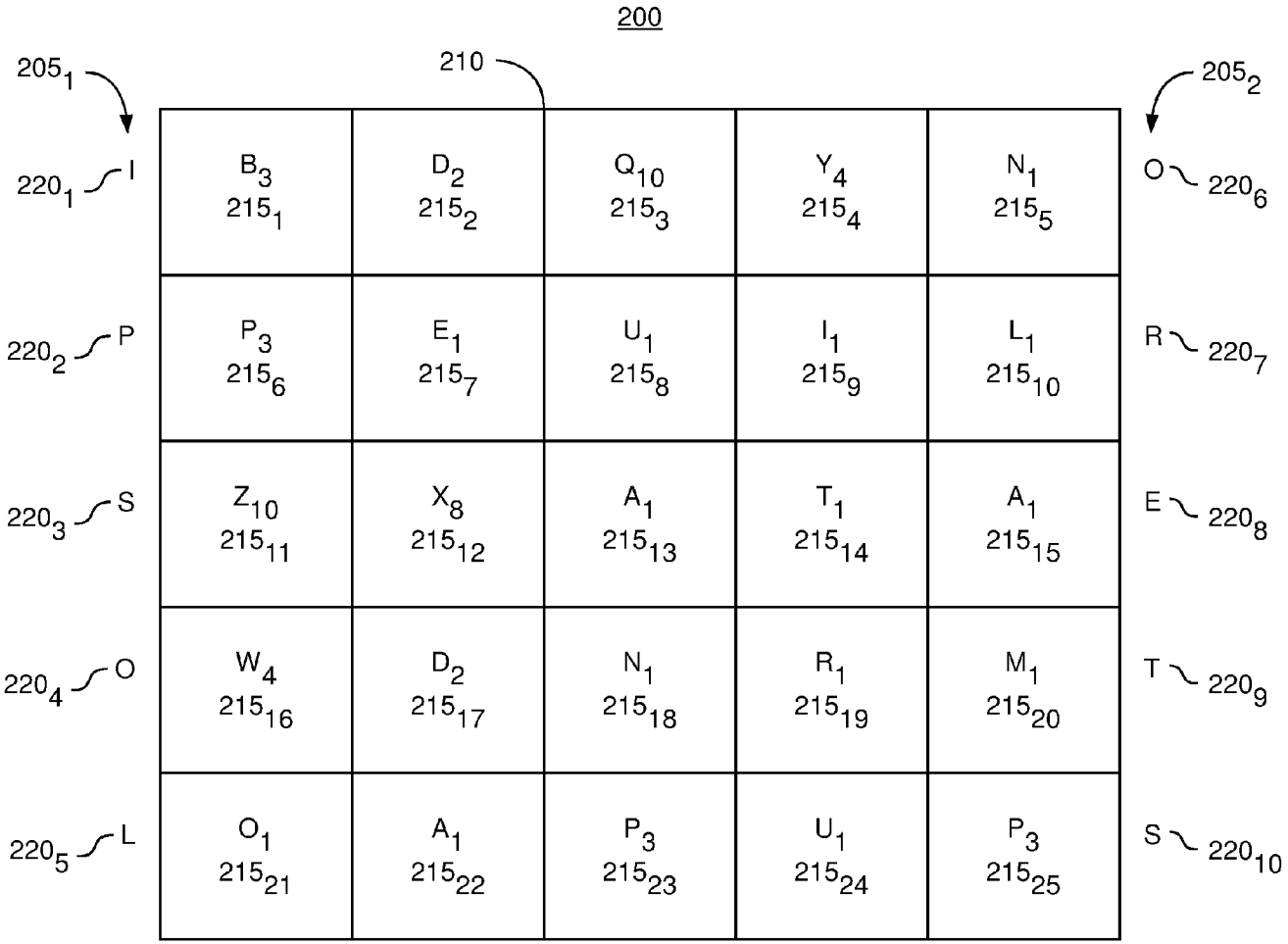
FIG. 2 is a screenshot illustrating a game board for a word game client, according to one embodiment described herein.

FIG. 2 is a screenshot illustrating a game board for a word game client, according to one embodiment described herein. As shown, the game board 200 includes a play area 210 and two bench areas $\mathbf{205}_1$ and $\mathbf{205}_2$. The play area 210 includes a plurality of tiles $\mathbf{215}_{1\text{-}25}$, where each tile includes a letter and a corresponding point value. For example, tile $\mathbf{215}_1$ includes the letter "B" and the point value of "3", tile $\mathbf{215}_2$ contains the letter "D" and the point value of "2" and so on. Additionally, each of the bench areas $\mathbf{205}_1$ and $\mathbf{205}_2$ include a plurality of tiles $\mathbf{220}_{1\text{-}5}$ and $\mathbf{220}_{6\text{-}10}$, respectively.

Figure 3B:
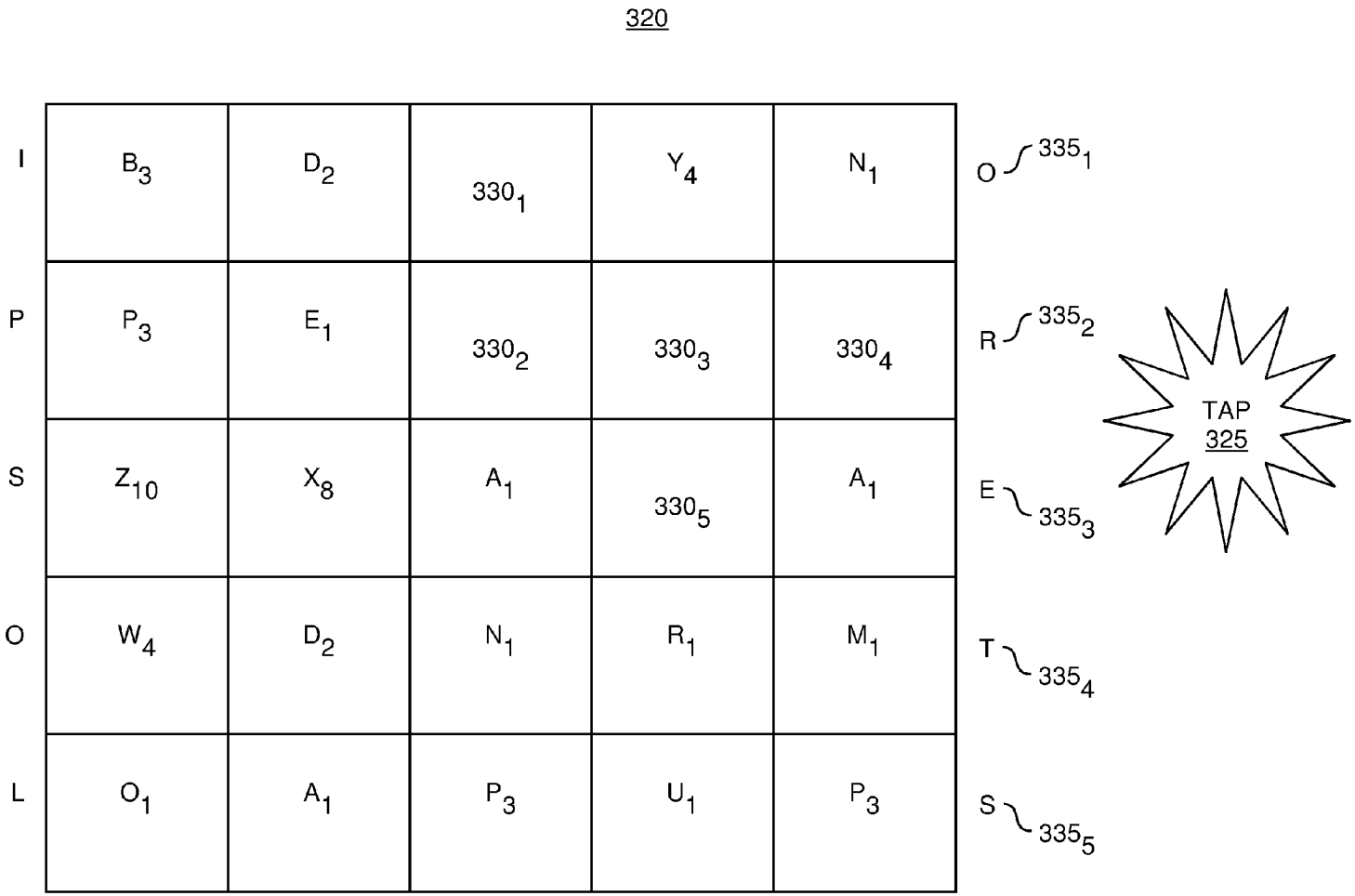

In an electronic embodiment, logic may be provided to facilitate the play of the word game. As used herein, such logic includes hardware elements and may additionally include software elements as well. Generally, these hardware and software elements are configured to control the play of the word game. As discussed above, the gameplay of the word game includes players taking turns selecting ordered sets of adjacent tiles from the play area to spell out words and earn points. The game client 115 may then remove the selected tiles from the play area and replenish the empty squares in the play area by sliding additional tiles onto the play area from a selected one of the bench areas. An example of this process will now be discussed with regard to FIGS. 3A-C, which are screenshots illustrating game boards for a word game client, according to one embodiment described herein. As shown, FIG. 3A is a screenshot 300 where the user has selected an ordered set of tiles $\mathbf{310}_{1\text{-}5}$. As discussed above, the order in which the user selects the tiles relates to the order in which the letters appear in the word being spelled. Thus, in the depicted embodiment, the user has made an ordered selection of tiles with the letters "Q", "U", "I", "L" and "T" to spell out the word "QUILT".

In one embodiment, the game client 115 may be configured to verify that the ordered selection of tiles spell out a valid word. For example, the game client 115 could determine the word spelled by the selected tiles and could search an electronic dictionary to determine whether the word is found within the dictionary. If the word is found, the game client 115 could determine that the word is valid. Otherwise, the game client 115 could determine the word is invalid. Additionally, the game client 115 may calculate a number of points to assign to the player spelling out the word. For instance, the game client 115 could be configured to calculate the sum of all the point values for the selected tiles. Thus, in the depicted example, the game client 115 could add up the point values of "10", "1", "1", "1" and 1" for the tiles with letters "Q", "U", "I", "L" and "T", respectively, and determine that 14 points should be assigned to the user for spelling out the word "QUILT".

As discussed above, once the points have been assigned to the player spelling out the word, the game client 115 may remove the selected tiles from the play area. An example of this is depicted in FIG. 3B, which is a screenshot illustrating a game board for a word game client. As shown, the screenshot 320 includes empty squares $\mathbf{330}_{1\text{-}5}$, representative of the squares where the selected tiles $\mathbf{310}_{1\text{-}5}$ were removed from the game board shown in screenshot 300. The player selecting the word man then select one of the bench areas for use in filling the empty squares $\mathbf{330}_{1\text{-}5}$ in the play area. In the depicted embodiment, the player has selected the bench containing the tiles $\mathbf{335}_{1\text{-}5}$, as shown by the action indicator 325.

In response to the selection of the bench area, the game client 115 may slide letters from the bench area onto the play area until the empty squares $\mathbf{330}_{1\text{-}5}$ are filled. This may include sliding any intermediate tiles within the play area as well. For instance, in the screenshot 320, the empty square $\mathbf{330}_1$ is not adjacent to the corresponding bench tile $\mathbf{335}_1$, but rather there are two intermediate tiles in the play area between the tiles $\mathbf{330}_1$ and $\mathbf{335}_1$ with the letters "Y" and "N". In such a scenario the game client 115 may slide the intermediate tiles over to cover any empty tiles and may then slide tiles from the bench onto the play area to fill any newly created empty tiles.

The result of such a process is shown in FIG. 3C, which is a screenshot illustrating a game board for a word client. As shown in the screenshot 340, the intermediate tiles $\mathbf{345}_1$ with letter "Y" and the tile $\mathbf{345}_2$ with the letter "N" have each moved one square to the left to fill the previously empty square $\mathbf{330}_1$. Additionally, the tile $\mathbf{345}_3$ with the letter "O" has moved onto the play area from its location on the bench as tile $\mathbf{335}_1$. The other tiles $\mathbf{345}_{4\text{-}9}$ were also moved in a similar fashion, being slid over from either within play area or the bench. Of note, for the tiles $\mathbf{345}_4$, $\mathbf{345}_5$ and $\mathbf{345}_6$, only one of these tiles was previously shown on the bench (i.e., the tile $\mathbf{345}_4$ with the letter "R" was previously shown as bench tile $\mathbf{335}_2$). As such, in this example, the game client 115 has selected additional tiles from the deck to replenish the bench area with letters "A" and "E", which were slide onto the play area as tiles $\mathbf{345}_8$ and $\mathbf{345}_9$.

Figure 4:
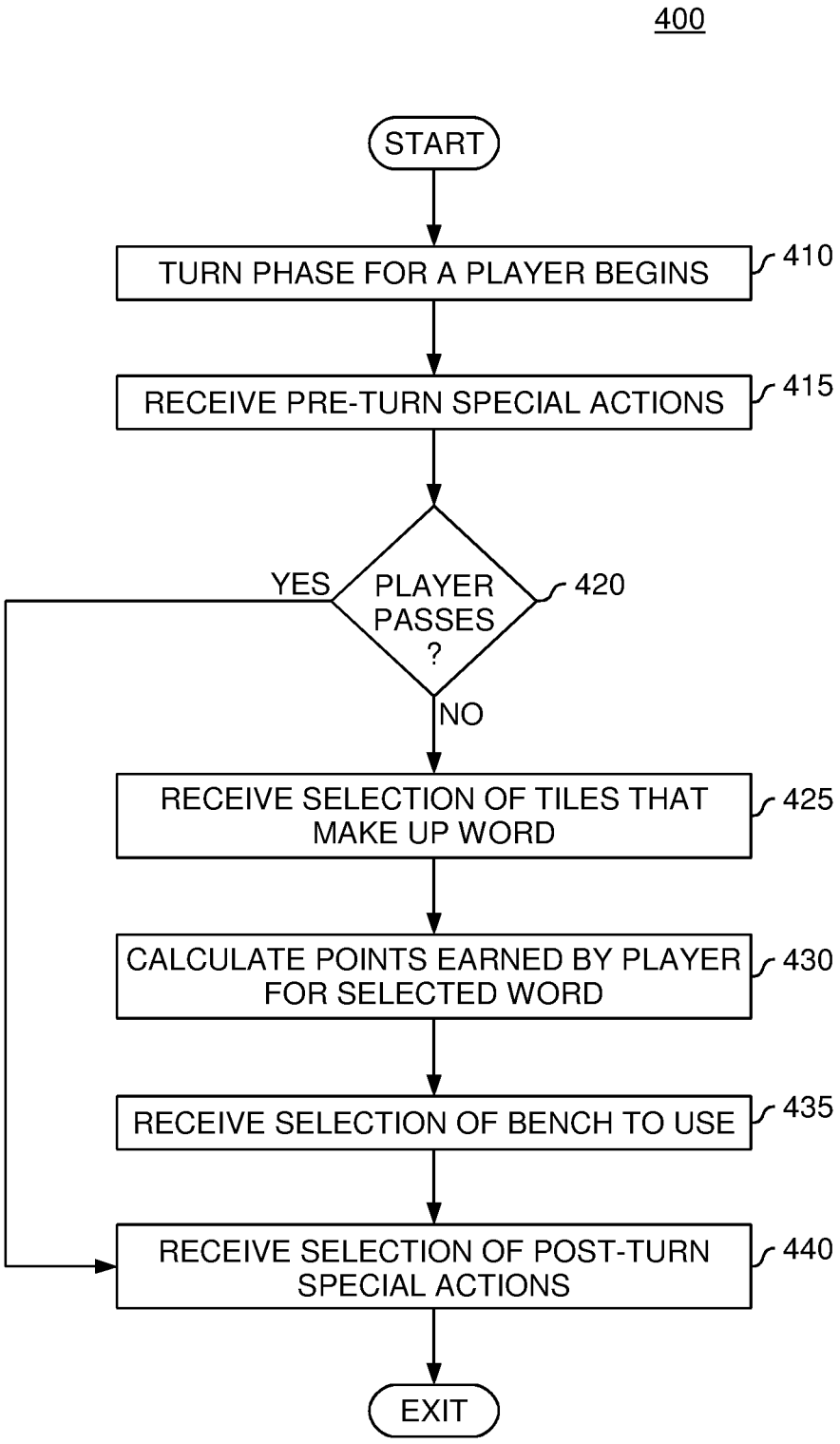
FIG. 4 is a flow diagram illustrating a method for playing a turn in a word game, according to one embodiment described herein.

FIG. 4 is a flow diagram illustrating a method for playing a turn in a word game, according to one embodiment described herein. The method 400 begins at step 410, where the word game client 115 initiates the turn phase for a player. As discussed above, a complete playthrough of the word game may include a predetermined number of rounds (e.g., 10 rounds), where each player takes a single turn per round. The game client 115 then receives a selection of any pre-turn special moves the player wishes to use on this turn (step 415). One example of such a pre-turn special moves is a "letter swap" action, which allows the user to swap the positions of two tiles in the play area. Similarly, a "trade" pre-turn action could be used to swap a tile from one of the bench areas with a tile currently in the play area. As another example, the user could select a "double turn score" pre-turn action, which will double any points earned by the user on the current turn. As yet another example, the user could select a "wipe" pre-turn action, which removes a selected row and/or column from the play area and replenishes the removed tiles using a selected one of the bench areas. The game client 115 could also be configured with an "undo" pre-turn special action, which removes any traps from the play area when used. Of course, these examples are provided without limitation and for illustrative purposes only. More generally, the player may select any pre-turn action that the player wishes to use on the current turn.

The game client 115 then determines whether the player wishes to pass on this turn (step 420). A player could choose to pass, for instance, when the player is unable to find any words using connected tiles on the game board. If the game client 115 determines the player does not wish to pass, then the game client 115 receives an ordered selection of a plurality of tiles that spell out a word (step 425). In particular embodiments, the game client 115 may be configured to analyze the ordered selection of tiles to ensure that the tiles spell out a valid word. For instance, the game client 115 could be configured to cross-reference the word formed by the ordered selection of tiles with an electronic dictionary to ensure that the word is valid.

Upon receiving the ordered selection of tiles, the game client 115 then calculates a number of points earned by the player for the selected word (step 430). As discussed above, each tile may include both a character value (i.e., a letter of the alphabet) and a point value (i.e., a numerical value). The game client 115 could be configured to calculate the sum of all the point values for the tiles in the ordered selection of tiles and award this total number of points to the player selecting the tiles. In particular embodiments, the game client 115 may further augment the calculated points by one or more bonuses or penalties. For example, if the user chose to use a "double turn score" pre-turn action this turn, the game client 115 could double the sum of the point values allocated to the user for this turn. In some embodiments, various squares within the play area may be associated with particular bonuses or penalties. If a tile within one of these squares is then used to form a word, the game client 115 could then use the bonus or penalty associated with the square to augment the points allocated to the player for the particular word. For instance, if the player spells a word using a tile on a "Double Letter Bonus" square, the game client 115 could be configured to double the amount of points assigned to the user for the tile on that square.

As discussed above, upon using a tile to construct a word, the game client 115 may be configured to remove the used tiles from the game board. For purposes of the present example, assume that the game client 115 is so configured and removes the ordered selection of tiles from the game board. The game client 115 then receives a selection of a bench to use in replenishing the empty tiles on the board (step 435). Upon receiving the selection of a bench, the game client 115 then replenishes the empty tiles on the game board by sliding tiles from the selected bench onto the game board and by shifting any tiles already on the game board accordingly. Additionally, although only one tile for each row or column is shown on the bench, if multiple tiles from a particular row or column are needed to fill the empty tiles on the game board, the game client 115 may be configured add additional tiles from the deck to the bench when sliding the tiles onto the game board.

Once the empty tiles on the game board are filled, or if the player chooses to pass his turn, the game client 115 receives a selection of any post-turn special moves the player wishes to play, and the method 400 ends. For example, the player could select a "trap" post-turn action, in which the player places a trap under one of the tiles in the play area. If one of the other players in the game uses the trapped tile to spell out a word, the trap may reduce that player's score for that turn to zero. In particular embodiments, various pre-turn actions may also be played as post turn actions. For example, the user could play a "letter swap" action as a post-turn action. Such an action could be used, for instance, when the user sees a particularly valuable word is available from tiles within the play area and wishes to prevent other users from spelling out this word.

Figure 5:
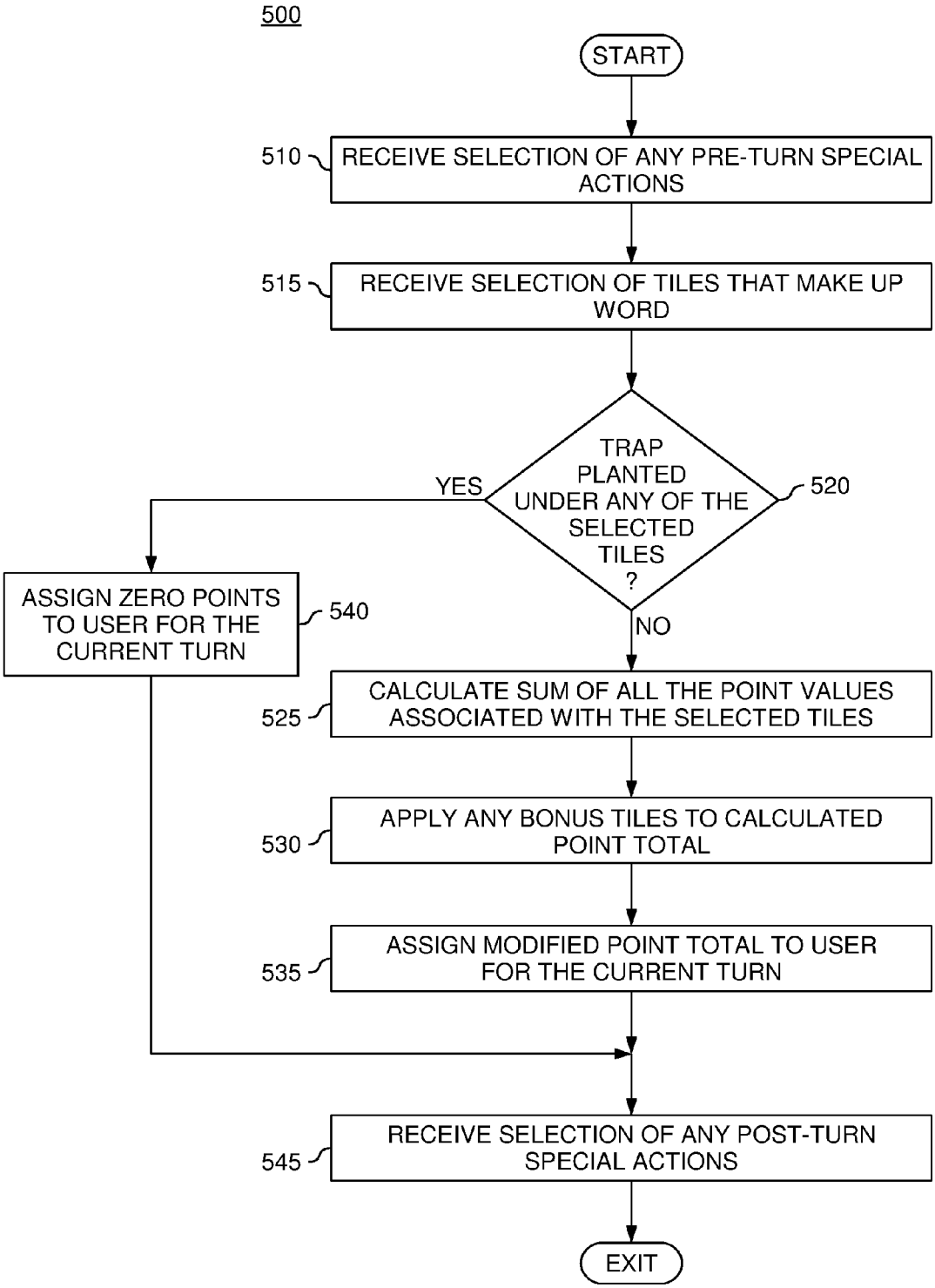
FIG. 5 is a flow diagram illustrating a method for playing a turn in a word game, according to one embodiment described herein.

FIG. 5 is a flow diagram illustrating a method for playing a turn in a word game, according to one embodiment described herein. The method 500 begins at step 510, where the word game client 115 receives a selection of pre-turn special actions. As discussed above, examples of pre-turn special actions include, without limitation, a "letters swap" action allowing the player to swap two tiles within the play area, a point multiplier action such as a "double turn score" action, a "trade" action allowing the player to swap a tile from within the play area with a tile in a bench area, a "wipe" action allowing a player to wipe out an entire row or column in the play area, an "undo" action removing any traps from the play area, and so on.

The game client 115 then receives an ordered selection of tiles from the game board that spell out a word (step 515). In one embodiment, the game client 115 is configured to verify that the ordered selection of tiles spell out a valid word. For instance, the game client 115 could be configured to look up the word spelled out by the ordered selection of tiles in an electronic dictionary. If the game client 115 cannot find the word in the electronic dictionary, the game client 115 could determine that the word is invalid. On the other hand, if the game client 115 finds the word in the dictionary, the game client 115 could determine that the word is indeed valid.

The game client 115 then determines whether a trap is planted under any of the selected tiles (step 520). For instance, the trap could be placed by another player of the word game during the post-turn phase of the other player's turn. In one embodiment, one or more traps may be automatically placed on the game board. For example, the game client 115 could be configured to randomly plant one or more traps on the game board during the word game. In particular embodiments, the game client 115 is configured to automatically plant traps throughout the game board under certain circumstances. For instance, the game client 115 could be configured to plant one or traps on the game board on predetermined rounds throughout the game (e.g., on the last round of the game).

Upon determining that no traps are planted under any of the selected tiles, the game client 115 calculates the sum of all the point values associated with the selected tiles (step 525). Additionally, the game client 115 applies any bonuses associated with the selected tiles (step 530). For instance, one example of a bonus tile could be a word multiplier bonus, such as a "Double Word Score" bonus. In such an example, the game client 115 could double the calculated sum of point values for the word. Other examples of such a bonus tile include, without limitation, additional point bonuses that are added to a word formed using the bonus tile (e.g., +5 points) and a letter multiple bonus (e.g., triple letter score). The game client 115 may also be configured to apply any penalties associated with the selected tiles. That is, while a bonus tile may be add to the score for a given word, a penalty tile may reduce the score for a given word. Examples of such penalties include, without limitation, multiplier penalties (e.g., a "Half Word Score" bonus), a negative point penalty (e.g., −5 points), and a letter multiplier penalty (e.g., half letter score). Particular embodiments may also include bonuses and penalties that affect a player's total score. For instance, such a bonus could be a "Double Total Score" bonus that affects not only the player's turn for the current turn but doubles the player's total score for all the previous turns as well.

Once any bonuses and penalties have been applied to the point total, the game client 115 assigns the modified point total to the user whose turn it is (step 535). On the other hand, if the game client 115 determined that a trap was planted under one of the selected tiles, the game client 115 assigns zero points to the user for the current turn (step 540). As discussed above, the game client 115 may assign zero points to the user for the current turn in the event that the user chooses to pass his or her turn (e.g., if the user is unable to form a word using an ordered selection of tiles on the game board). Once the game client assigns the modified point total to the user or, in the event of a trap or the user passes no points to the user, the game client 115 receives a selection of post-turn special actions from the user (step 545) and the method 500 ends.

Generally, the pre-turn and post-turn actions may include any actions that the user can take before or after selecting a set of ordered tiles that make up a word. For instance, one example of such a post-turn action includes placing a bomb under one or more tiles of the game board that will stay in effect during each of the other players' turns. As another example, the player could select a "Double Turn Score" power-up that acts as a bonus and doubles the players' score for the current turn. In one embodiment, the game client 115 may allocate a predetermined one or more special actions to each player at the beginning of the game and these actions may then be used as either pre-turn or post-turn actions during the game. In another embodiment, the game client 115 is configured to allocate pre-turn and post-turn actions may be allocated to each player separately at various times (e.g., at the beginning of the game, throughout the game, etc.).

Generally, each player may receive a score for each round of the game based on the word the player formed on the respective round (or no points in the event the player passed on the round). These scores may then be added up and the player with the greatest total score declared the winner of the game. Advantageously, by incorporating bonus and penalty tiles, as well as the pre- and post-turn actions, into the word game, embodiments may introduce a deeper level of strategy into the gameplay of the word game.

In a particular embodiment, the game client 115 may allow the users to unlock pre-turn and post-turn actions for use in subsequently played games. For instance, the game client 115 could assign an amount of virtual currency to users for each game the users play. In such an embodiment, the game client 115 could also provide a bonus amount of virtual currency to a user when the user wins a game. Users could then use their virtual currency to purchase pre-turn and post-turn actions that can be used in subsequent games. In one embodiment, the game client 115 is configured to allow users to purchase pre-turn and post-turn actions using real currency (e.g., dollars). Once purchased, the users can then use these unlocked actions in subsequent games. The game client 115 may restrict purchased actions to a predetermined number of uses. For instance, the game client 115 could restrict the purchased actions to a predetermined number of users per game and/or a predetermined number of total uses.

Figure 6:
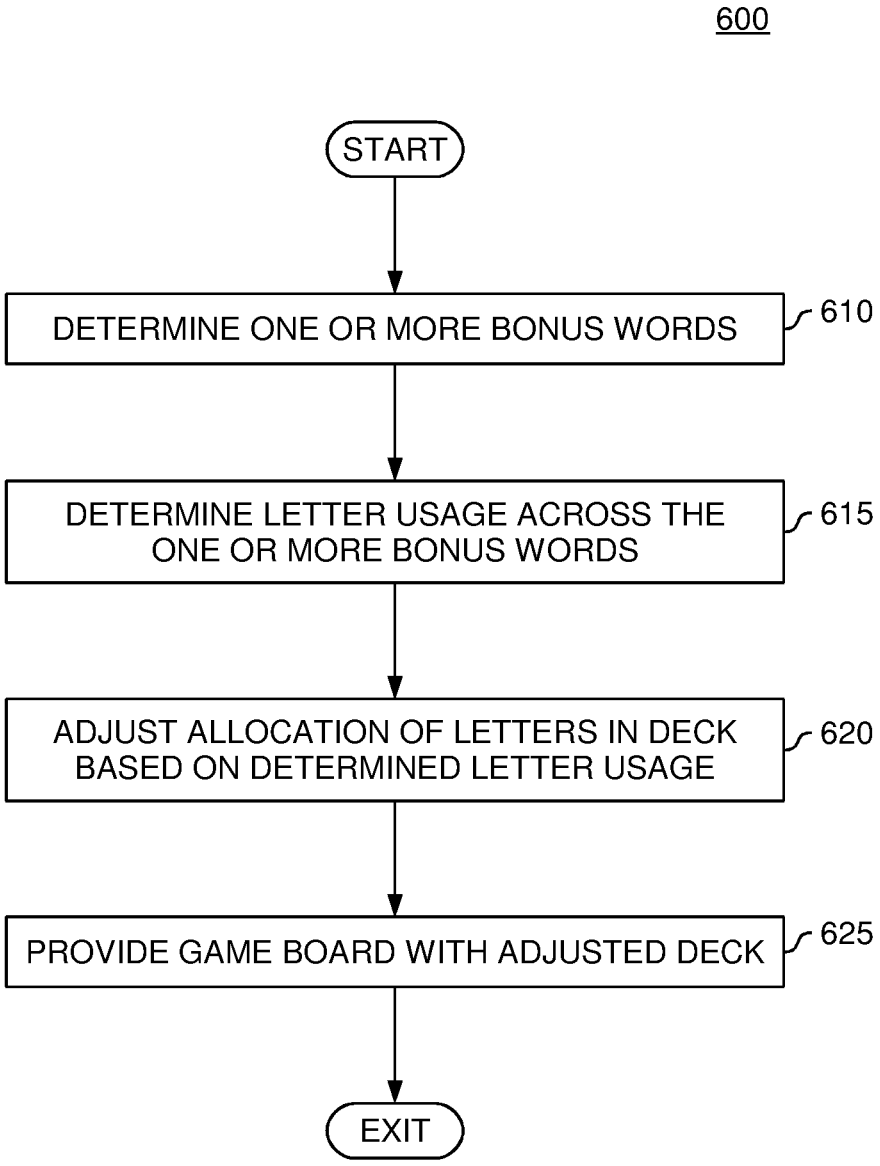
FIG. 6 is a flow diagram illustrating a method for dynamically generating a deck in a word game, according to one embodiment described herein.

As discussed above, the deck refers to the set of tiles from which the game board and the benches are populated. In some embodiments, the deck is a predetermined set of tiles. However, in one embodiment, the game client 115 is configured to generate the deck dynamically. An example of such an embodiment is shown in FIG. 6, which is a flow diagram illustrating a method for dynamically generating a deck in a word game. As shown, the method 600 begins at step 610, where the game client 115 determines one or more bonus words. Generally, a "bonus word" refers to any word that the game client 115 provides a bonus for when a player spells out the word using the tiles of the game board (i.e., a reward in addition to the score normally associated with spelling out a word). For example, the game client 115 could be configured to use the word "Santa" as a bonus word during the Christmas season. If a user then selects an ordered set of tiles that spell out the word Santa, the game client 115 could provide a bonus reward to the user. The bonus reward could be, for instance, an adjustment to the number of points earned for spelling out the word (e.g., a flat bonus of points, a point multiplier, etc.). As another example, the game client 115 could be configured to reward the user with an amount of virtual currency as a bonus reward for spelling out a bonus word on the game board.

In one embodiment, the game client 115 is configured to provide the user with a bonus reward upon the user spelling out each of the one or more bonus rewards. For example, assume that the game client 115 is configured to use the words "Santa", "Rudolph" and "Frosty" as bonus words during the Christmas season. In such an example, the game client 115 could be configured to provide a user with an additional reward upon the user spelling out each and every one of these bonus words on the game board in one or more playthroughs of the word game. Advantageously, doing so not only encourages the user to search for the bonus words during a particular playthrough of the word game but may also encourage the user to continue playing the word game until the user has found all of the bonus words and collected the additional reward. Additionally, such a reward may be additional to the bonus reward for spelling out each of the bonus words. Thus, in this example, the game client 115 could be configured to reward the user with a first bonus whenever the user spells out one of the bonus words (e.g., a point bonus for the current playthrough of the word game) and to reward the user with a second bonus whenever the user has spelled out each of the bonus words at least once (e.g., an amount of virtual currency).

The bonus words may be randomly selected as "Words of the Day" and the selection may change once per day. In one embodiment, the bonus words may be a set of words that share a common theme. As an example, the game client 115 could be configured to use a set of words relating to a new film as bonus words in order to interweave elements of the word game with the film and to provide additional attention to the new film. The game client 115 may be further configured to treat these words are bonus words for a fixed period of time. For example, the game client 115 could be configured to select a number of words associated with the new film and to consider the selected words as bonus words for a week. Once the week has expired, the game client 115 could then select a number of different words associated with the new film to be the bonus words for the upcoming week. Of course, these examples are provided without limitation and for illustrative purposes only. More generally, any technique for selecting one or more words to be considered bonus words may be used.

Once the bonus words are determined, the game client 115 determines an allocation of letters across the one or more bonus words (step 615). For instance, continuing the above example with "Santa", "Rudolph" and "Frosty" as bonus words, the game client 115 could determine that the letter "A" is used twice across these bonus words, the letter "B" is used zero times across these bonus words, and so on. The game client 115 then adjusts the allocation of letters within the deck based on the determined letter usage across the bonus words (step 620). The game client 115 then provides the game board using the adjusted deck to two or more players for use in playing the word game (step 625) and the method 600 ends.

For example, assume that the game client 115 has determined that the letter "Y" is used 4 times across a particular set of bonus words. In such an example, the game client 115 could determine that the deck should be adjusted to contain multiple occurrences of the letter "Y". Advantageously, doing so helps to ensure that users can more easily spell out the bonus words, even when the bonus words contain an atypical number of more obscure letters. That is, while only a small percentage of words in the English language may contain the letter "Y", a particular set of bonus words may include many words that contain the letter "Y". Thus, by dynamically adjusting the deck based on the allocation of letters across the bonus words, embodiments help to ensure that the users do not have an unduly difficult time finding the bonus words within the game board.

Figure 7:
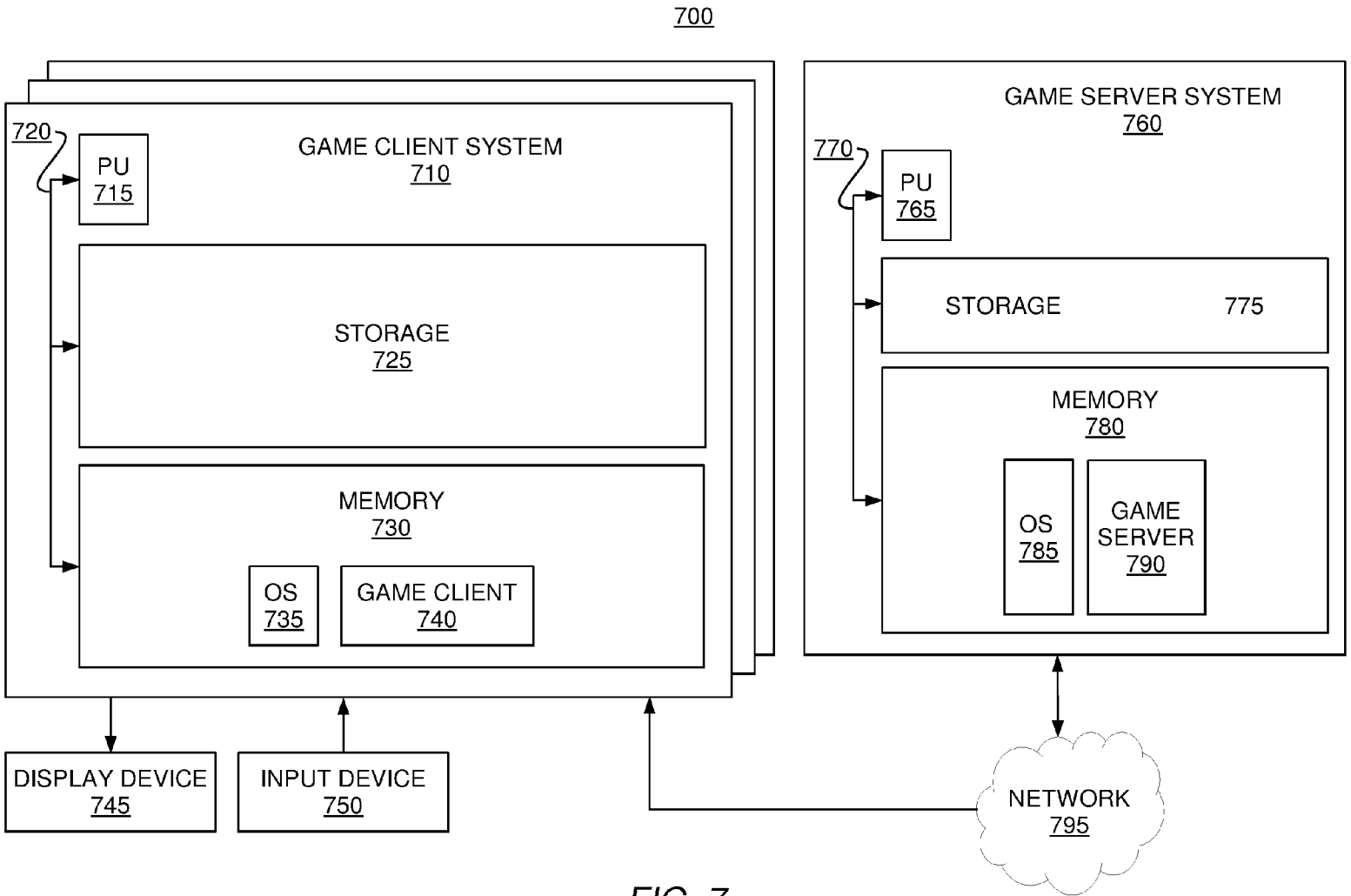
FIG. 7 is a block diagram illustrating a system configured with a word game client, according to one embodiment described herein.

FIG. 7 is a block diagram illustrating a system configured with a word game client, according to one embodiment described herein. As shown, the system 700 includes a plurality of game client systems 710 and a server system 760, communicatively coupled via a network 795. In one embodiment, the game client systems 710 may include existing computer systems, e.g., desktop computers, server computers, laptop computers, tablet computers, gaming consoles, handheld gaming devices and the like. The game client systems 710 illustrated in FIG. 7, however, are merely examples of computer systems in which embodiments of the present invention may be used. Embodiments of the present invention may be implemented differently, regardless of whether the computer systems are complex multi-user computing systems, such as a cluster of individual computers connected by a high-speed network, single-user workstations, or network appliances lacking non-volatile storage. Moreover, it is explicitly contemplated that embodiments of the invention may be implemented using any device or computer system capable of performing the functions described herein.

As shown, each client system 710 includes, without limitation, a processor 715, which obtains instructions and data via a bus 720 from a memory 730 and storage 725. Processor 715 is a programmable logic device that performs instruction, logic, and mathematical processing, and may be representative of one or more CPUs. Storage 725 is representative of hard-disk drives, flash memory devices, optical media and the like. Generally, the storage 725 stores application programs and data for use by the client system 710. The client systems 710 are operably connected to the network 795, e.g., via network interfaces.

The memory 730 is any memory sufficiently large to hold the necessary programs and data structures. Memory 730 could be one or a combination of memory devices, including Random Access Memory, nonvolatile or backup memory (e.g., programmable or Flash memories, read-only memories, etc.). In addition, memory 730 and storage 725 may be considered to include memory physically located elsewhere; for example, on another computer coupled to the client system 710 via bus 720. The memory 730 includes a game client 740 and an operating system ("OS") 735. Operating system 735 is software used for managing the operation of the game client system 710. Examples of OS 735 include UNIX, versions of the Microsoft Windows® operating system and distributions of the Linux® operating system. Additional examples of operating system 735 include custom operating systems for gaming consoles, including the custom operating systems for systems such as the Microsoft Xbox 360®, Nintendo Wii® and Sony PlayStation® 3.

Additionally, the client systems 710 each are coupled to display devices 745 and input devices 750. The display devices 745 may include output devices such as monitors, touch screen displays, and so on. For instance, the display devices 745 may include a display device used to visually depict a virtual environment. As an example, the display 745 may provide a touch sensitive surface allowing the user to select different locations within the virtual environment and control the movement of an avatar within the virtual environment. The input devices 750 represent a wide variety of input devices, including keyboards, mice, controllers, and so on. Furthermore, the input devices 750 may include a set of buttons, switches or other physical device mechanisms for controlling the client system 710. For example, the input devices 750 could include a set of directional buttons used to navigate an avatar through a virtual environment presented on the display 745.

As shown, the game server system 760 includes, without limitation, a processor 765, which obtains instructions and data via a bus 770 from a memory 780 and storage 775. Processor 765 is a programmable logic device that performs instruction, logic, and mathematical processing, and may be representative of one or more CPUs. Storage 775 is representative of hard-disk drives, flash memory devices, optical media and the like. Generally, the storage 775 stores application programs and data for use by the server system 760. The server system 760 is operably connected to the network 795, e.g., via a network interface.

The memory 780 is any memory sufficiently large to hold the necessary programs and data structures. Memory 780 could be one or a combination of memory devices, including Random Access Memory, nonvolatile or backup memory (e.g., programmable or Flash memories, read-only memories, etc.). In addition, memory 780 and storage 775 may be considered to include memory physically located elsewhere; for example, on another computer coupled to the server system 760 via bus 770. The memory 780 includes an OS 785, and a game server 790. Operating system 785 is software used for managing the operation of the game server system 760. Examples of OS 785 include UNIX, versions of the Microsoft Windows® operating system and distributions of the Linux® operating system. Additional examples of operating system 785 include custom operating systems for gaming consoles, including the custom operating systems for systems such as the Microsoft Xbox 360®, Nintendo Wii® and Sony PlayStation® 3.

As discussed above, the game client 115 could connect to the game server 790 and/or to other game clients to enable two or more users to play a word game configured with a sliding mechanic. In the word game, the players may take turns selecting ordered sets of adjacent tiles within a play area in order to spell out words. The game client 115 may then reward the players with some number of points, based on the tiles the players selected. The selected tiles are then removed from the play area and replaced by sliding tiles onto the play area from a selected bench area. This may continue until one of the players is determined to be the winner of the word game (e.g., the player with the highest number of points after 10 rounds of game play).

In the preceding, reference is made to embodiments of the invention. However, the invention is not limited to specific described embodiments. Instead, any combination of the following features and elements, whether related to different embodiments or not, is contemplated to implement and practice the invention. Furthermore, although embodiments of the invention may achieve advantages over other possible solutions and/or over the prior art, whether or not a particular advantage is achieved by a given embodiment is not limiting of the invention. Thus, the preceding aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Embodiments of the invention may be provided to end users through a cloud computing infrastructure. Cloud computing generally refers to the provision of scalable computing resources as a service over a network. More formally, cloud computing may be defined as a computing capability that provides an abstraction between the computing resource and its underlying technical architecture (e.g., servers, storage, networks), enabling convenient, on-demand network access to a shared pool of configurable computing resources that can be rapidly provisioned and released with minimal management effort or service provider interaction. Thus, cloud computing allows a user to access virtual computing resources (e.g., storage, data, applications, and even complete virtualized computing systems) in "the cloud," without regard for the underlying physical systems (or locations of those systems) used to provide the computing resources.

Typically, cloud computing resources are provided to a user on a pay-per-use basis, where users are charged only for the computing resources actually used (e.g. an amount of storage space consumed by a user or a number of virtualized systems instantiated by the user). A user can access any of the resources that reside in the cloud at any time, and from anywhere across the Internet. In context of the present invention, a user may access applications (e.g., a game server 790) or related data available in the cloud. For example, the players could use a game client 740 to connect to the game server 790 within the cloud in order to play a word game configured with a sliding mechanic. Doing so allows the players to play the word game from a computing system attached to a network connected to the cloud (e.g., the Internet).

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Each block of the block diagrams and/or flowchart illustration, and combinations of blocks in the block diagrams and/or flowchart illustration, can be implemented by special-purpose hardware-based systems that perform the specified functions or acts, or combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. A method of playing a word game with one or more players, comprising:

generating, by operation of one or more computer processors, a representation of a game board, the game board comprising:

a play area including a plurality of tiles from a deck of tiles; and at least two bench areas, each including a set of tiles from the deck of tiles, wherein each of the at least two bench areas are arranged as a column or a row adjacent to the play area, and wherein each tile in the deck of tiles specifies a letter and a point value;

providing logic, by operation of the one or more computer processors, that facilitates play of at least one round of the word game, wherein a round includes a turn for each of the one or more players, and wherein a turn comprises:

receiving an ordered selection of tiles within the play area that form a word;

removing the tiles in the ordered selection of tiles from the play area;

receiving a selection of one of the at least two bench areas;

replacing empty tiles within the play area by sliding tiles from the selected bench area onto the play area;

receiving a selection of one or more post-turn actions comprising a trap action that places a trap in association with a selected one of the plurality of tiles within the play area, wherein any word formed by one of the other players using the selected tile associated with the second trap will automatically be assigned a point value of zero points.

2. The method of claim 1, further comprising:

for each of the one or more players, calculating a total score for the respective player, comprising:

calculating a word score for each word formed by the player, based on the point values specified by the tiles in the ordered selection of tiles for the word; and calculating a sum of the word scores to determine the total score for the respective player;

and determining a winner of the word game, based on the calculated total scores for the one or more players.

3. The method of claim 2, wherein calculating a word score for each word formed by the player is further based on one or more bonus squares in the play area on which at least one of the tiles in the ordered selection of tiles was placed, wherein the one or more bonus squares comprise at least one of a word multiplier bonus, a letter multiplier bonus, a total score multiplier bonus, and a flat point bonus.

4. The method of claim 2, wherein calculating a word score for each word formed by the player is further based on one or more penalty squares in the play area on which at least one of the tiles in the ordered selection of tiles was placed, wherein the one or more penalty squares comprise at least one of a word multiplier penalty, a letter multiplier penalty, a total score multiplier penalty, and a flat point penalty.

5. The method of claim 2, wherein calculating a word score for each word formed by the player further comprises:

upon determining that the trap is associated with one of the tiles in the ordered selection of tiles for a first one of the turns, calculating a word score of zero for the word formed using the ordered selection of tiles on the first turn as the penalty for the trap.

6. The method of claim 1, wherein a turn further comprises:

receiving a selection of one or more pre-turn actions, the one or more pre-turn actions comprising at least one of a letter swap action allowing the current player to change the position of two tiles within the play area, a trade action allowing the current player to change the position of a tile within the play area and a tile within one of the bench areas, a point multiplier action modifying any points earned by the current player on the current turn, a wipe action removing an entire row or column from the play area and replacing the removed row or column from a selected one of the bench areas, and an undo action removing any traps within the play area.

7. The method of claim 1, further comprising:

identifying one or more bonus words;

determining an allocation of letters across the identified one or more bonus words; and dynamically generating the deck of tiles, based on the determined allocation of letters.

8. A system, comprising:

a processor; and a memory containing a program that, when executed by the processor, performs an operation for playing a word game with one or more players, comprising:

providing a game board comprising:

a play area including a plurality of tiles from a deck of tiles; and at least two bench areas, each including a set of tiles from the deck of tiles, wherein each of the at least two bench areas are arranged as a column or a row adjacent to the play area, and wherein each tile in the deck of tiles specifies a letter and a point value;

providing logic to facilitate play of at least one round of the word game, wherein a round includes a turn for each of the one or more players, and wherein a turn comprises:

receiving an ordered selection of tiles within the play area that form a word;

removing the tiles in the ordered selection of tiles from the play area;

receiving a selection of one of the at least two bench areas;

replacing empty tiles within the play area by sliding tiles from the selected bench area onto the play area; and receiving a selection of one or more post-turn actions comprising a trap action that places a trap in association with a selected one of the plurality of tiles within the play area, wherein any word formed by one of the other players using the selected tile associated with the second trap will automatically be assigned a point value of zero points.

9. The system of claim 8, the operation further comprising:

for each of the one or more players, calculating a total score for the respective player, comprising:

calculating a word score for each word formed by the player, based on the point values specified by the tiles in the ordered selection of tiles for the word; and calculating a sum of the word scores to determine the total score for the respective player;

and determining a winner of the word game, based on the calculated total scores for the one or more players.

10. The system of claim 9, wherein calculating a word score for each word formed by the player is further based on one or more bonus squares in the play area on which at least one of the tiles in the ordered selection of tiles was placed, wherein the one or more bonus squares comprise at least one of a word multiplier bonus, a letter multiplier bonus, a total score multiplier bonus, and a flat point bonus.

11. The system of claim 9, wherein calculating a word score for each word formed by the player is further based on one or more penalty squares in the play area on which at least one of the tiles in the ordered selection of tiles was placed, wherein the one or more penalty squares comprise at least one of a word multiplier penalty, a letter multiplier penalty, a total score multiplier penalty, and a flat point penalty.

12. The system of claim 9, wherein calculating a word score for each word formed by the player further comprises:

upon determining that the trap is associated with one of the tiles in the ordered selection of tiles for a first one of the turns, calculating a word score of zero for the word formed using the ordered selection of tiles on the first turn as the penalty for the trap.

13. The system of claim 8, wherein a turn further comprises:

receiving a selection of one or more pre-turn actions, the one or more pre-turn actions comprising at least one of a letter swap action allowing the current player to change the position of two tiles within the play area, a trade action allowing the current player to change the position of a tile within the play area and a tile within one of the bench areas, a point multiplier action modifying any points earned by the current player on the current turn, a wipe action removing an entire row or column from the play area and replacing the removed row or column from a selected one of the bench areas, and an undo action removing any traps within the play area.

14. The system of claim 8, the operation further comprising:

identifying one or more bonus words;

determining an allocation of letters across the identified one or more bonus words; and dynamically generating the deck of tiles, based on the determined allocation of letters.

15. A computer program product for playing a word game with one or more players, comprising:

a non-transitory computer-readable medium having computer readable program code embodied therewith, the computer readable program code comprising:

computer readable program code to provide a game board comprising:

a play area including a plurality of tiles from a deck of tiles; and at least two bench areas, each including a set of tiles from the deck of tiles, wherein each of the at least two bench areas are arranged as a column or a row adjacent to the play area, and wherein each tile in the deck of tiles specifies a letter and a point value;

computer readable program code to provide logic to facilitate play of at least one round of the word game, wherein a round includes a turn for each of the one or more players, and wherein a turn comprises:

receiving an ordered selection of tiles within the play area that form a word;

removing the tiles in the ordered selection of tiles from the play area;

receiving a selection of one of the at least two bench areas;

replacing empty tiles within the play area by sliding tiles from the selected bench area onto the play area; and receiving a selection of one or more post-turn actions comprising a trap action that places a trap in association with a selected one of the plurality of tiles within the play area, wherein any word formed by one of the other players using the selected tile associated with the second trap will automatically be assigned a point value of zero points.

16. The computer program product of claim 15, the computer readable program code further comprising:

computer readable program code to, for each of the one or more players, calculate a total score for the respective player, comprising:

computer readable program code to calculate a word score for each word formed by the player, based on the point values specified by the tiles in the ordered selection of tiles for the word; and computer readable program code to calculate a sum of the word scores to determine the total score for the respective player;

and computer readable program code to determine a winner of the word game, based on the calculated total scores for the one or more players.

17. The computer program product of claim 16, wherein the computer readable program code to calculate a word score for each word formed by the player operates further based on one or more bonus squares in the play area on which at least one of the tiles in the ordered selection of tiles was placed, wherein the one or more bonus squares comprise at least one of a word multiplier bonus, a letter multiplier bonus, a total score multiplier bonus, and a flat point bonus.

18. The computer program product of claim 16, wherein the computer readable program code to calculate a word score for each word formed by the player operates further based on one or more penalty squares in the play area on which at least one of the tiles in the ordered selection of tiles was placed, wherein the one or more penalty squares comprise at least one of a word multiplier penalty, a letter multiplier penalty, a total score multiplier penalty, and a flat point penalty.

19. The computer program product of claim 16, wherein the computer readable program code to calculate a word score for each word formed by the player further comprises:

upon determining that the trap is associated with one of the tiles in the ordered selection of tiles for a first one of the turns, calculating a word score of zero for the word formed using the ordered selection of tiles on the first turn as the penalty for the trap.

20. The computer program product of claim 15, wherein a turn further comprises:

receiving a selection of one or more pre-turn actions, the one or more pre-turn actions comprising at least one of a letter swap action allowing the current player to change the position of two tiles within the play area, a trade action allowing the current player to change the position of a tile within the play area and a tile within one of the bench areas, a point multiplier action modifying any points earned by the current player on the current turn, a wipe action removing an entire row or column from the play area and replacing the removed row or column from a selected one of the bench areas, and an undo action removing any traps within the play area.

21. The computer program product of claim 15, the computer readable program code further comprising:

computer readable program code to identify one or more bonus words;

computer readable program code to determine an allocation of letters across the identified one or more bonus words; and computer readable program code to dynamically generate the deck of tiles, based on the determined allocation of letters.

22. A method of playing a word game with one or more players, comprising:

generating, by operation of one or more computer processors, a representation of a game board, the game board comprising:

a play area including a plurality of tiles from a deck of tiles; and at least two bench areas, each including a set of tiles from the deck of tiles, wherein each of the at least two bench areas are arranged as a column or a row adjacent to the play area, and wherein each tile in the deck of tiles specifies a letter and a point value;

providing logic, by operation of the one or more computer processors, that facilitates play of at least one round of the word game, wherein a round includes a turn for each of the one or more players, and wherein a turn comprises:

receiving an ordered selection of tiles within the play area that form a word;

removing the tiles in the ordered selection of tiles from the play area;

receiving a selection of one of the at least two bench areas;

replacing empty tiles within the play area by sliding tiles from the selected bench area onto the play area; and for each of the one or more players, calculating a total score for the respective player, comprising:

calculating a word score for each word formed by the player, based on the point values specified by the tiles in the ordered selection of tiles for the word;

calculating a sum of the word scores to determine the total score for the respective player; and upon determining that the trap is associated with one of the tiles in the ordered selection of tiles for a first one of the turns, calculating a word score of zero for the word formed using the ordered selection of tiles on the first turn as the penalty for the trap; and determining a winner of the word game, based on the calculated total scores for the one or more players.

23. A system, comprising:

a processor; and a memory containing a program that, when executed by the processor, performs an operation for playing a word game with one or more players, the operation comprising:

generating a representation of a game board, the game board comprising:

a play area including a plurality of tiles from a deck of tiles; and at least two bench areas, each including a set of tiles from the deck of tiles, wherein each of the at least two bench areas are arranged as a column or a row adjacent to the play area, and wherein each tile in the deck of tiles specifies a letter and a point value;

providing logic that facilitates play of at least one round of the word game, wherein a round includes a turn for each of the one or more players, and wherein a turn comprises:

receiving an ordered selection of tiles within the play area that form a word;

removing the tiles in the ordered selection of tiles from the play area;

receiving a selection of one of the at least two bench areas;

replacing empty tiles within the play area by sliding tiles from the selected bench area onto the play area; and for each of the one or more players, calculating a total score for the respective player, comprising:

calculating a word score for each word formed by the player, based on the point values specified by the tiles in the ordered selection of tiles for the word;

calculating a sum of the word scores to determine the total score for the respective player; and upon determining that the trap is associated with one of the tiles in the ordered selection of tiles for a first one of the turns, calculating a word score of zero for the word formed using the ordered selection of tiles on the first turn as the penalty for the trap; and determining a winner of the word game, based on the calculated total scores for the one or more players.

24. A computer program product for playing a word game with one or more players, comprising:

a non-transitory computer-readable medium having computer readable program code embodied therewith, the computer readable program code comprising:

computer readable program code to provide game board comprising:

a play area including a plurality of tiles from a deck of tiles; and at least two bench areas, each including a set of tiles from the deck of tiles, wherein each of the at least two bench areas are arranged as a column or a row adjacent to the play area, and wherein each tile in the deck of tiles specifies a letter and a point value;

computer readable program code to provide logic to facilitate play of at least one round of the word game, wherein a round includes a turn for each of the one or more players, and wherein a turn comprises:

receiving an ordered selection of tiles within the play area that form a word;

removing the tiles in the ordered selection of tiles from the play area;

receiving a selection of one of the at least two bench areas;

replacing empty tiles within the play area by sliding tiles from the selected bench area onto the play area; and computer readable program code to, for each of the one or more players, calculate a total score for the respective player, comprising:

calculating a word score for each word formed by the player, based on the point values specified by the tiles in the ordered selection of tiles for the word;

calculating a sum of the word scores to determine the total score for the respective player; and upon determining that the trap is associated with one of the tiles in the ordered selection of tiles for a first one of the turns, calculating a word score of zero for the word formed using the ordered selection of tiles on the first turn as the penalty for the trap; and computer readable program code to determine a winner of the word game, based on the calculated total scores for the one or more players.

* * * * *